US010174479B2

(12) United States Patent
Ciarla

(10) Patent No.: US 10,174,479 B2
(45) Date of Patent: Jan. 8, 2019

(54) DUAL BLADE IMPLEMENT SYSTEM

(71) Applicant: Caterpillar Inc., Peoria, IL (US)

(72) Inventor: Biagio Ciarla, Appleton, WI (US)

(73) Assignee: Caterpillar Inc., Deerfield, IL (US)

( * ) Notice: Subject to any disclaimer, the term of this patent is extended or adjusted under 35 U.S.C. 154(b) by 211 days.

(21) Appl. No.: 15/377,807

(22) Filed: Dec. 13, 2016

(65) Prior Publication Data

US 2018/0163367 A1 Jun. 14, 2018

(51) Int. Cl.

| | |
|---|---|
| ***E02F 3/80*** | (2006.01) |
| ***E02F 3/84*** | (2006.01) |
| ***E02F 3/76*** | (2006.01) |
| ***E02F 3/815*** | (2006.01) |
| ***E02F 3/96*** | (2006.01) |

(52) U.S. Cl.

CPC ..... *E02F 3/844* (2013.01); *E02F 3/7609* (2013.01); *E02F 3/815* (2013.01); *E02F 3/8155* (2013.01); *E02F 3/962* (2013.01)

(58) Field of Classification Search

CPC ..... E02F 3/815; E02F 3/8152; E02F 3/8155; E02F 3/844; E02F 3/962

USPC ..... 37/407, 408, 409, 410, 903; 172/779, 172/786, 787, 199, 815, 382

See application file for complete search history.

(56) References Cited

U.S. PATENT DOCUMENTS 2,262,415 A * 11/1941 Williams ..... E02F 3/8155 172/777
3,490,539 A 1/1970 Hilmes et al.
3,835,932 A 9/1974 Mitchell
4,241,525 A * 12/1980 Mann ..... E02F 3/7609 172/748
4,372,063 A * 2/1983 Work ..... A01G 23/093 37/301
5,427,185 A 6/1995 Seal
6,206,106 B1 3/2001 Heckendorf
6,278,955 B1 8/2001 Hartman et al.
6,615,929 B2 9/2003 Heckendorf
7,913,431 B1 * 3/2011 Beam ..... A01G 23/06 37/406
7,942,209 B1 5/2011 Gary et al.
8,634,991 B2 1/2014 Douglas
9,506,215 B2 * 11/2016 Krell ..... E02F 3/404
(Continued)

FOREIGN PATENT DOCUMENTS

CA 2255189 6/2000
WO WO2004057116 7/2004

*Primary Examiner* — Gary S Hartmann

(57) ABSTRACT

An implement system for a machine includes a primary blade and a secondary blade coupled to the primary blade through a linkage mechanism such that the secondary blade is trailing the primary blade. The implement system includes an actuator which controls a movement of the secondary blade. The implement system includes at least one position sensor which generates signals indicative of a position of the primary blade and a position of the secondary blade. The implement system further includes a controller which is in communication with the primary blade, the secondary blade and the position sensor. The controller receives the signals indicative of the position of the primary blade and the position of the secondary blade. The controller operates the actuator to control the movement of the secondary blade based on the position of the primary blade and secondary blade.

20 Claims, 7 Drawing Sheets

(56) References Cited

U.S. PATENT DOCUMENTS

| | | | | |
|---|---|---|---|---|
| 2007/0163792 | A1* | 7/2007 | Parrish | E02F 3/8152<br>172/777 |
| 2008/0000659 | A1 | 1/2008 | Zachman | |

* cited by examiner

DUAL BLADE IMPLEMENT SYSTEM

TECHNICAL FIELD

The present disclosure relates to an implement system for an earth moving machine. More specifically, the present disclosure relates to a dual blade implement system.

BACKGROUND

Earthmoving or geography altering machines such as track type tractors, motor graders, scrapers, and/or backhoe loaders, have an implement such as a dozer blade or bucket, which is used on a worksite in order to alter a geography or terrain of a section of earth. The implement may be controlled by an operator or by an autonomous grade control system to perform work on the worksite. For example, the operator may move an operator input device that controls the movement or positioning of the implement using one or more hydraulic actuators. To achieve a final surface contour or a final grade, the implement may be adjusted to various positions by the operator or the grade control system.

Positioning the implement, however, is a complex and time-consuming task that requires expert skill and diligence if the operator is controlling the movement. Conventional machines deploy proportional (P), proportional-derivative (PD), proportional-integral (PI), and/or proportional-integral-derivative (PID) controllers to attain position control of various machine implements. Such controllers may be deployed in combination with a Global Positioning System (GPS) receiver on the machine. However, since the implement is heavy and carries added weight of earth being dug as well, it becomes difficult for a control system to readily adjust the implement position and make the implement adhere to the desired control instructions. In such a case, it may be possible that the implement may not impart the desired geometry to a surface in a single pass. It may take multiple passes to get desired results which may be detrimental to overall efficiency of the operation.

For example, U.S. Pat. No. 6,615,929 describes a method and apparatus for high speed grading of a road in a single pass. A grader includes a frame supported above a surface. Two blades are pivotally fixed to the frame, and can be positioned to engage the surface. A first biasing mechanism biases the blades toward a forward position. At least one leveling board is pivotally fixed to the frame, and can be positioned to engage the surface towards rear of the blade. A second biasing mechanism biases the leveling board toward a forward position. A packing mechanism is fixed towards rear of the leveling board, and can be positioned to engage the surface. However, both the blades are of similar size and are controlled in a similar manner. Even though angle of the leveling boards can be controlled relative to the blades, it may be difficult to perform different functions with both the blades.

Thus, an improved implement system is required for efficient grading operations.

SUMMARY

In an aspect of the present disclosure, an implement system for a machine includes a primary blade and a secondary blade coupled to the primary blade through a linkage mechanism such that the secondary blade is trailing the primary blade. The implement system includes an actuator which controls a movement of the secondary blade. The implement system includes at least one position sensor which generates signals indicative of a position of the primary blade and a position of the secondary blade. The implement system further includes a controller which is in communication with the primary blade, the secondary blade and the position sensor. The controller receives the signals indicative of the position of the primary blade and the position of the secondary blade. The controller operates the actuator to control the movement of the secondary blade based on the position of the primary blade and secondary blade.

In another aspect of the present disclosure, a secondary implement system is provided for retrofitting to a machine. The machine includes a primary implement system having a primary blade and a primary controller. The secondary implement system includes a secondary blade coupled to the primary blade through a linkage mechanism, such that the secondary blade is trailing the primary blade. The secondary implement system includes an actuator which controls a movement of the secondary blade. The secondary implement system includes at least one position sensor which generates signals indicative of a position of the secondary blade. The secondary implement system further includes a secondary controller in communication with the primary controller, the secondary blade and the position sensor. The secondary controller receives a signal indicative of a position of the primary blade from the primary controller. The secondary controller receives the signals indicative of the position of the secondary blade from the position sensor. The secondary controller operates the actuator to control the movement of the secondary blade based on the position of the primary blade and secondary blade.

In yet another aspect of the present disclosure, a method of controlling an implement system for a machine working on a ground surface is provided. The implement system includes a primary blade, and a secondary blade coupled to the primary blade, such that the secondary blade is trailing the primary blade. The method includes receiving an initial geometry and a final geometry of the ground surface by a controller. The method includes receiving a signal indicative of a position of the primary blade by the controller. The method includes receiving a signal indicative of a position of the secondary blade by the controller. The method includes operating the primary blade based on the initial geometry and the position of the primary blade through the controller. The method includes receiving an intermediate geometry of the ground surface, after the primary blade has altered the initial geometry of the ground surface by the controller. The method further includes operating an actuator to control movement of the secondary blade based on the intermediate geometry of the ground surface, and the position of the secondary blade through the controller.

DETAILED DESCRIPTION

Figure 1:
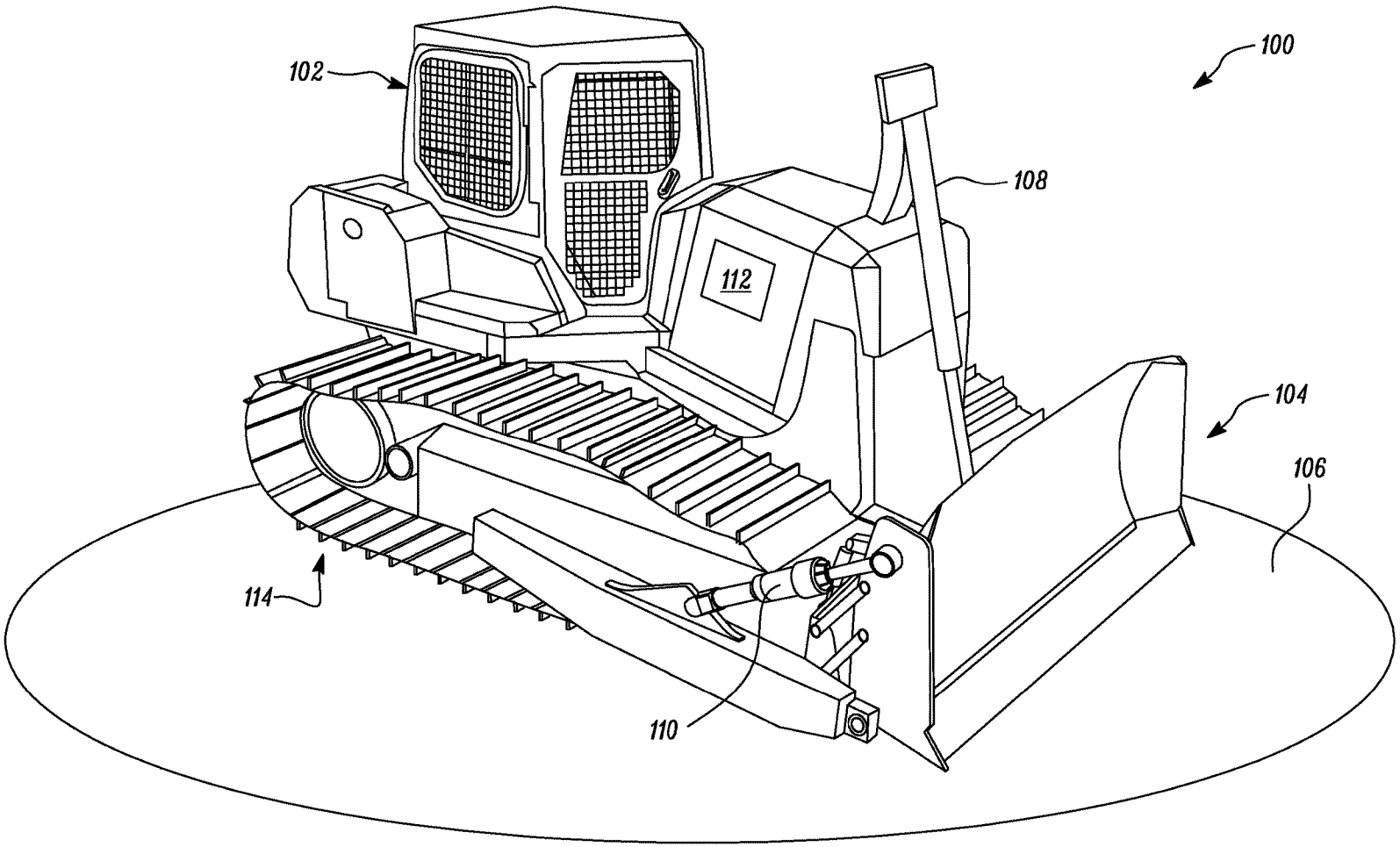
FIG. 1 is a perspective view of a machine having an implement system, in accordance with an embodiment of the present disclosure.

Wherever possible, the same reference numbers will be used throughout the drawings to refer to same or like parts. FIG. 1 illustrates an exemplary machine 100. The machine 100 may be a mobile machine that performs operations associated with industries such as mining, construction, farming, transportation, landscaping, or the like. For example, the machine 100 may be a track type tractor or dozer, as depicted in FIG. 1, a motor grader, or any other earth-moving machine known in the art. While the following detailed description describes an exemplary aspect in connection with a track type tractor, it should be appreciated that the description applies equally to the use of the present disclosure in other machines.

As shown, the machine 100 includes an operator's station or cab 102. The cab 102 may include a user interface (not shown) necessary to operate the machine 100. The user interface may be provided along with or may include, for example, one or more displays. The user interface may be configured to propel the machine 100 and/or to control other machine components. The user interface may include one or more joysticks provided within the cab 102, and adapted to receive an input from an operator indicative of a desired movement of the machine 100. The display may be configured to convey information to the operator and may include a keyboard, touch screen, or any suitable mechanism for receiving input from the operator to control and/or operate the machine 100, and/or the other machine components.

The machine 100 further includes an implement system 104. The implement system 104 may be adapted to engage, penetrate, or cut a ground surface 106 of a worksite and may be further adapted to move the earth to accomplish a predetermined task. The worksite may include, for example, a mine site, a landfill, a quarry, a construction site, a golf course, or any other type of worksite having an associated terrain. Moving the earth may be associated with altering the geography of the ground surface 106 at the worksite and may include, for example, a grading operation, a scraping operation, a leveling operation, a material removal operation, or any other type of geography altering operation at the worksite. In one aspect, the terrain of the worksite has operating conditions associated therewith. Such operating conditions may be described using parameters such as a type of material making the terrain, a dryness factor of the terrain, one or more disturbances present in the terrain (e.g., waves, undulations, or uneven surfaces), and/or other geographical patterns of the terrain of the worksite, and the like.

The machine 100 may include hydraulic mechanisms to actuate the implement system 104. The hydraulic mechanisms may include one or more hydraulic lift actuators 108 and one or more hydraulic tilt actuators 110, for moving the implement system 104 to various positions, such as, for example, lifting or lowering the implement system 104 and tilting the implement system 104 left or right. In the illustrated embodiment, the machine 100 includes one hydraulic lift actuator 108 and two hydraulic tilt actuators 110, one on each side of the implement system 104. Only one of the two hydraulic tilt actuators 110 is shown (only one side shown). Moreover, the hydraulic mechanism may also include one or more hydraulic push cylinders (not shown) for pitching the implement system 104 in forward or backward direction.

The machine 100 may further include a power source 112. The power source 112 may be an engine that provides power to a ground engaging mechanism 114 adapted to support, steer, and propel the machine 100. In one embodiment, the power source 112 may provide power to actuate the hydraulic mechanism to move or position the implement system 104. The power source 112 may embody an engine such as, for example, a diesel engine, a gasoline engine, a gaseous fuel-powered engine, or any other type of combustion engine known in the art. It is contemplated that the power source 112 may alternatively embody a non-combustion source of power (not shown) such as, for example, a fuel cell, a power storage device, or another suitable source of power. The power source 112 may produce a mechanical or electrical power output that may be converted to hydraulic power for providing power to the ground engaging mechanism 114, the implement system 104, the hydraulic lift actuator 108, the one or more hydraulic tilt actuators 110, and other machine components.

The machine 100 may include other known components such as vehicular parts including tires, wheels, transmission, engine, motor, hydraulic systems, suspension systems, cooling systems, fuel systems, exhaust systems, chassis, ground engaging tools, imaging systems, and the like. The machine 100 also includes various sensors for sensing various parameters related to the machine 100. The machine 100 may be movable along different directions for the implement system 104 to implement a predetermined grade on the ground surface 106 of the worksite.

Figure 2:
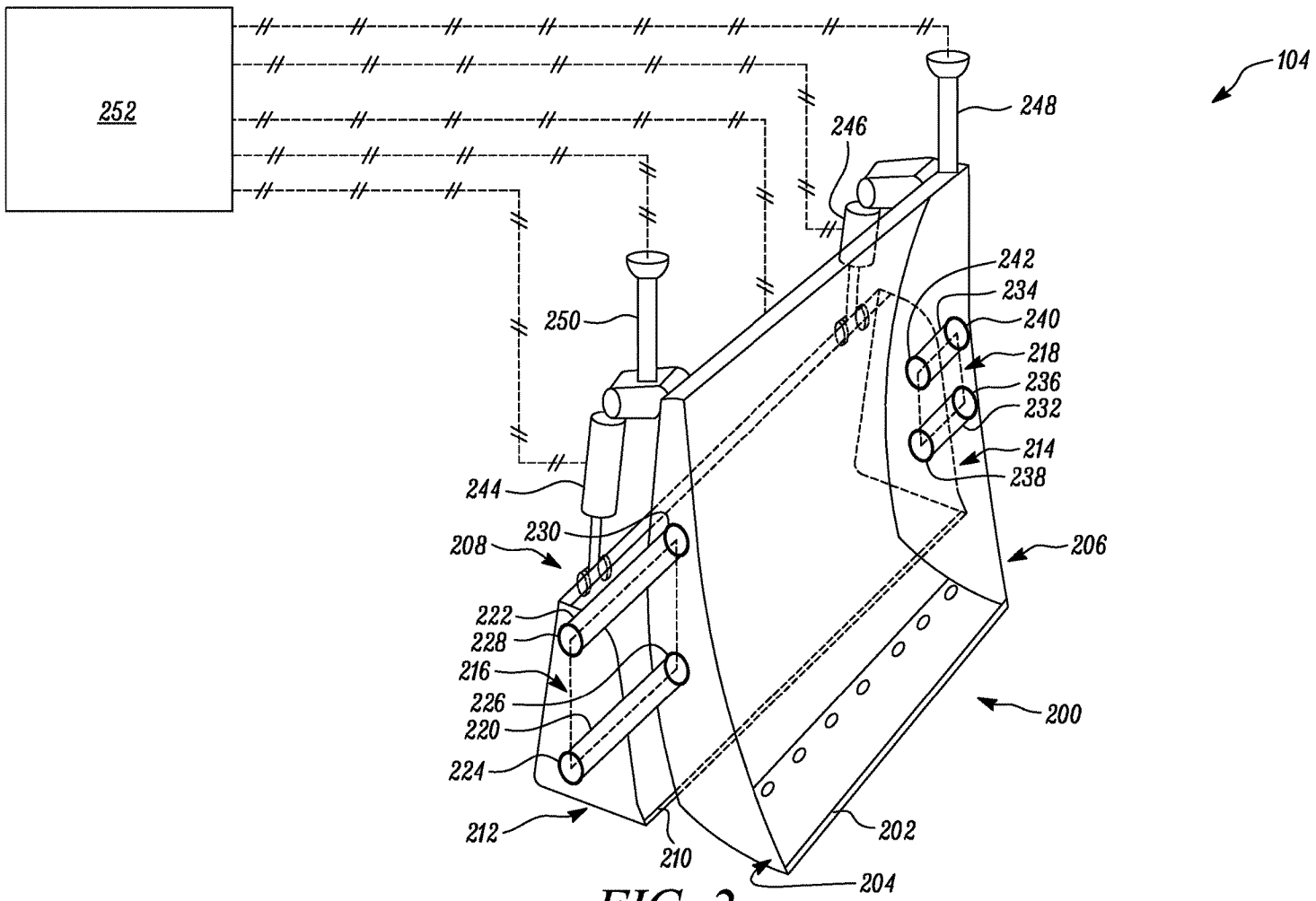
FIG. 2 is a perspective view of the implement system of the machine, in accordance with an embodiment of the present disclosure.
Figure 3:
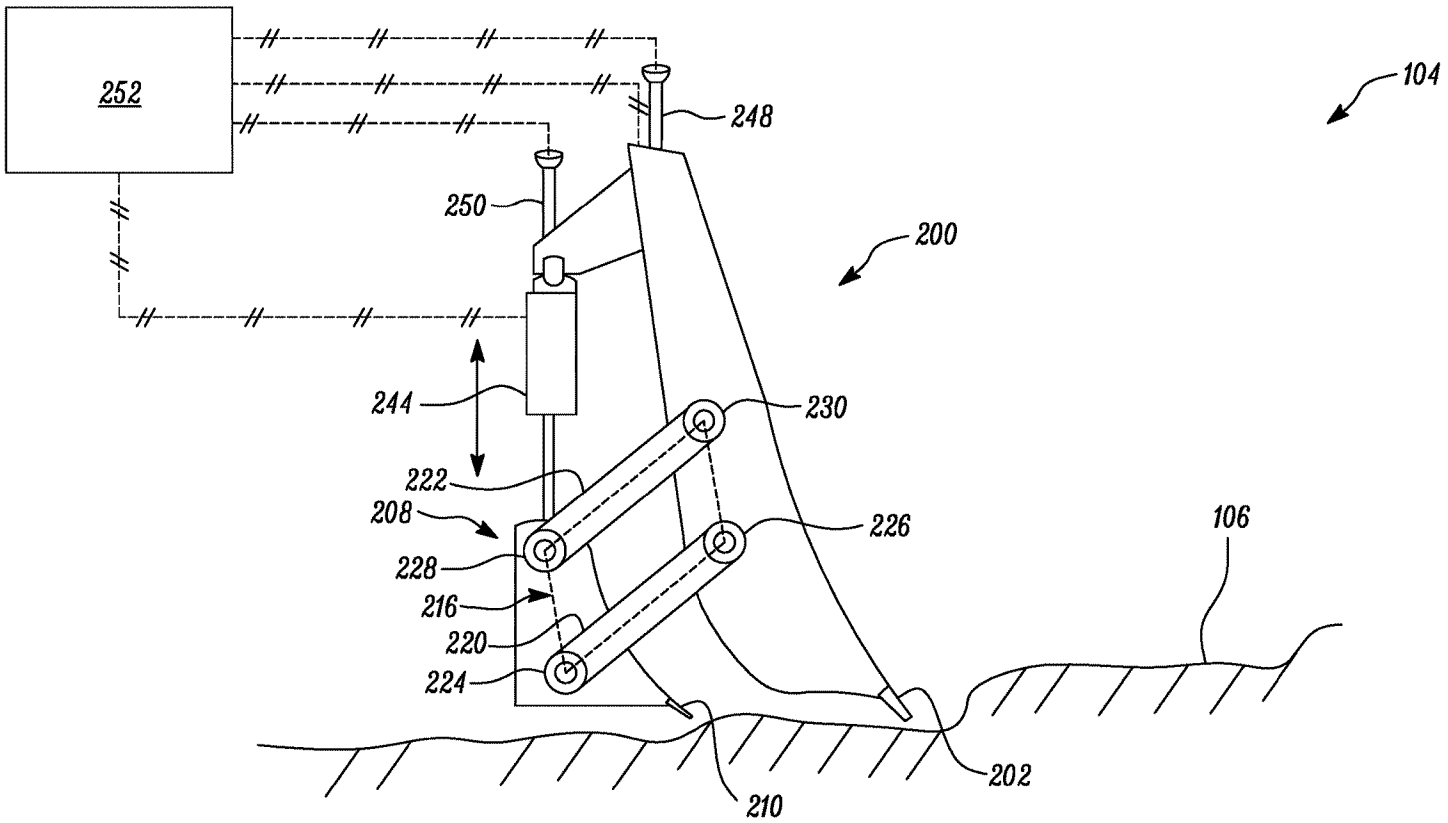
FIG. 3 is a side view of the implement system of the machine, in accordance with an embodiment of the present disclosure.

FIGS. 2 and 3 illustrate further structural details of the implement system 104. With combined reference to FIGS. 2 and 3, the implement system 104 includes a primary blade 200 which may be used to alter the ground surface 106. The primary blade 200 has a primary cutting edge 202 extending from a first end 204 of the primary blade 200 to a second end 206 of the primary blade 200. The primary cutting edge 202 may be a sharp, hardened metal strip which may easily contact, and subsequently alter the ground surface 106. The primary cutting edge 202 may also have any other such composition as well which may suit the present disclosure. The primary cutting edge 202 may be coupled to the primary blade 200 through mechanical joining mechanism such as welding, mechanical fasteners etc. The primary cutting edge 202 may be coupled to the primary blade 200 through any other suitable mechanism as well which may suit the need of the application for which the implement system 104 is being used. Movement of the primary blade 200 is controlled through the hydraulic lift actuators 108 and the hydraulic tilt actuators 110.

The implement system 104 further includes a secondary blade 208 trailing the primary blade 200. The secondary blade 208 has a secondary cutting edge 210 extending from a first end 212 of the secondary blade 208 to a second end 214 of the secondary blade 208. The secondary cutting edge 210 may be a sharp, hardened metal strip which may easily contact, and subsequently alter the ground surface 106. The secondary cutting edge 210 may also have any other such composition as well which may suit the present disclosure. The secondary cutting edge 210 may be coupled to the secondary blade 208 through mechanical joining mechanism such as welding, mechanical fasteners etc. The secondary cutting edge 210 may be coupled to the secondary blade 208 through any other suitable mechanism as well which may suit the need of the application for which the implement system 104 is being used.

The secondary blade 208 is coupled to the primary blade 200 through a first linkage mechanism 216 towards the first end 204 of the primary blade 200 and a second linkage mechanism 218 towards the second end 206 of the primary blade 200. The first and second linkage mechanisms 216, 218 may be any type of linkage mechanisms which may allow simultaneous as well as independent movement of the primary blade 200 and the secondary blade 208. In the illustrated embodiment, the first linkage mechanism 216 and the second linkage mechanism 218 are four-bar linkage mechanisms.

The first linkage mechanism 216 includes a first link member 220 and a second link member 222 coupling the primary blade 200 and the secondary blade 208 towards the first end 204 of the primary blade 200. The first link member 220 is coupled to the primary blade 200 and the secondary blade 208 through pivot pins 224, 226 respectively. Similarly, the second link member 222 is coupled to the primary blade 200 and the secondary blade 208 through pivot pins 228, 230 respectively. The primary blade 200, the first link member 220, the secondary blade 208, and the second link member 222 form four bars of the first linkage mechanism 216. The pivot pins 224, 226, 228, 230 constitute the vertices of the first linkage mechanism 216. The first link member 220 and the second link member 222 may rotate about the pivot pins 224, 226, 228, 230 to the extent permitted by relative geometry of the primary blade 200, the secondary blade 208 and the first linkage mechanism 216.

Similarly, the second linkage mechanism 218 includes a third link member 232 and a fourth link member 234 coupled to the primary blade 200 and the secondary blade 208 towards the second end 206 of the primary blade 200. The third link member 232 is coupled to the primary blade 200 and the secondary blade 208 through pivot pins 236, 238 respectively. Similarly, the fourth link member 234 is coupled to the primary blade 200 and the secondary blade 208 through pivot pins 240, 242 respectively. The third link member 232 and the fourth link member 234 may rotate about the pivot pins 236, 238, 240, 242 to the extent permitted by relative geometry of the primary blade 200, the secondary blade 208 and the second linkage mechanism 218. It should be contemplated that the first and second linkage mechanisms 216, 218 may be any other type of linkage mechanisms as well which may be suitable to the need of the present disclosure.

Movement of the secondary blade 208 is controlled through a first actuator 244 towards the first end 212 of the secondary blade 208 and a second actuator 246 towards the second end 214 of the secondary blade 208. The first and second actuators 244, 246 may be a cylinder-piston assembly, a mechanical linkage, or any other type of actuators which may suit the need of the present disclosure. The first and second actuators 244, 246 may be actuated through hydraulic or pneumatic means. In the illustrated embodiment, the first and second actuators 244, 246 are cylinder-piston assemblies. The first and second actuators 244, 246 may be actuated through hydraulic or pneumatic means to control the movement of the secondary blade 208.

The implement system 104 includes a first position sensor 248 and a second position sensor 250. The first position sensor 248 generates signals indicative of position of the primary blade 200 and the second position sensor 250 generates signals indicative of the position of the secondary blade 208. The first position sensor 248 and the second position sensor 250 may be any type of conventional positions sensors which may accurately sense the positions of the primary blade 200 and the secondary blade 208, and subsequently generate signals indicative of the same. In one embodiment, the first position sensor 248 and the second position sensor 250 are GPS sensors.

The first position sensor 248 is attached to the primary blade 200 and the second position sensor 250 is attached to the secondary blade 208. The first position sensor 248 and the second position sensor 250 may be attached to the primary blade 200 and the secondary blade 208 respectively at any location. The positions of the first and second position sensors 248, 250 on the primary and secondary blades 200, 208 respectively should be such that the signals generated by the first and second position sensors 248, 250 provide an accurate account of the positions of the primary and secondary blades 200, 208 respectively with respect to the ground surface 106. The first and second position sensors 248, 250 may be attached to the primary and secondary blades 200, 208 respectively through any suitable coupling means in context of the present disclosure. It should be contemplated that a single position sensor may also be employed to generate signals corresponding to positions of both the primary blade 200 and the secondary blade 208.

The implement system 104 further includes a controller 252 in communication with the primary blade 200, the secondary blade 208, the first position sensor 248, and the second position sensor 250. The controller 252 may be a single controller or a group of multiple controllers configured to control various components of the implement system 104. The controller 252 may be an integral part of a machine control system controlling various functions and components of the machine 100. The controller 252 may also be a separate controller which is connected to the machine control system. The controller 252 may have an associated memory to store various operational parameters related to the machine 100. The operational parameters may include such as, but not limited to, mass of the machine 100, dimensions of the machine 100, model of the machine 100 etc. The controller 252 may also store a single or multiple terrain maps having information related to the ground surface 106 on which the machine 100 is travelling.

The terrain map may be a database containing previously-gathered points defining geometry of the ground surface 106 of a particular terrain over which the machine 100 may work upon. The terrain map may, for example, store the previously-gathered points in a matrix form. Each point may include a location (e.g., Cartesian, polar, or spherical coordinate data) and/or other attributes (e.g., a grade) about the particular point on the ground surface 106 of the worksite. It is to be appreciated that as the worksite undergoes geographic alteration (e.g., excavation), geometry of the ground surface 106 may change with time. Accordingly, the terrain map stores a matrix containing points defining the most recently scanned and stored geometry of the ground surface 106 of the worksite. In one embodiment, the points may be previously-gathered by various sensors. Alternatively or additionally, the points may be previously-gathered by satellite imagery, aerial mapping, surveys, and/or other terrain mapping means known in the art.

The controller 252 may store an initial geometry terrain map and a final geometry terrain map corresponding to an initial geometry and a desired final geometry of the ground surface 106. The initial geometry terrain map may include information about various parameters defining the initial geometrical condition of the ground surface 106 and the final geometry terrain map may include information about a desired final geometrical condition of the ground surface 106 required after undergoing geographic alterations by the implement system 104. Further, the controller 252 may also be provided with intermediate geometries of the ground surface 106 in real time as the implement system 104 alters the ground surface 106. The intermediate geometry of the ground surface 106 may be used by the controller 252 to track the progress of the operation being performed by the machine 100 and subsequently control the implement system 104 as well.

The implement system 104 performs the alteration of the ground surface 106 by using both the primary blade 200 and the secondary blade 208 in tandem. The secondary blade 208 complements the work of the primary blade 200 done on the ground surface 106. The primary blade 200 is used to perform coarse cutting action and the secondary blade 208 is used to perform fine cutting action so as to make sure that the alteration of the ground surface 106 from initial geometry to the final geometry is performed in a single pass only. Further, there is substantial difference between the size and weight of the primary blade 200 and the secondary blade 208. The primary blade 200 is heavier than the secondary blade 208. Size of the primary blade 200, as illustrated, is bigger than the secondary blade 208. The difference in weight and size allows the implement system 104 to simultaneously operate both the primary blade 200 and secondary blade 208 and yet achieve significantly different functions from the primary blade 200 and the secondary blade 208.

The primary blade 200 and the secondary blade 208 while working on the ground surface 106 accumulate a lot of earth which gets dug up through the primary and secondary cutting edges 202, 210 respectively and subsequently rises up along surfaces of the primary blade 200 and the secondary blade 208. The primary blade 200 and the secondary blade 208 may include openings (not shown) in sides of the primary blade 200 and the secondary blade 208 to allow the accumulated earth to pass from the sides. Thus, the accumulated earth does not comes in contact with the ground surface 106 being prepared by the machine 100 again and avoids any possible damage to the prepared ground surface 106.

The controller 252 may further be programmed to control the implement system 104 in case of the ground surface 106 having a lot of irregularities. In such a situation, the controller 252 may bypass the normal control logic and may focus on avoiding damage to the secondary blade 208. The controller 252 may control the first and second actuators 244, 246 to lift up the secondary blade 208 in a stowage position. Thus, the secondary blade 208 may not come in contact with the ground surface 106 and avoid damage to the secondary blade 208.

The controller 252 may also be programmed to control position of the primary blade 200 and the secondary blade 208 relative to the ground surface 106 such that the primary blade 200 and the secondary blade 208 remain steady in their respective positions while the implement system 104 is operating so as to impart desired grade/slope to the ground surface 106. For example, the controller 252 may have Accugrade® or Cat® Slope Assist, or CAT Grade Control etc.

Figure 4:
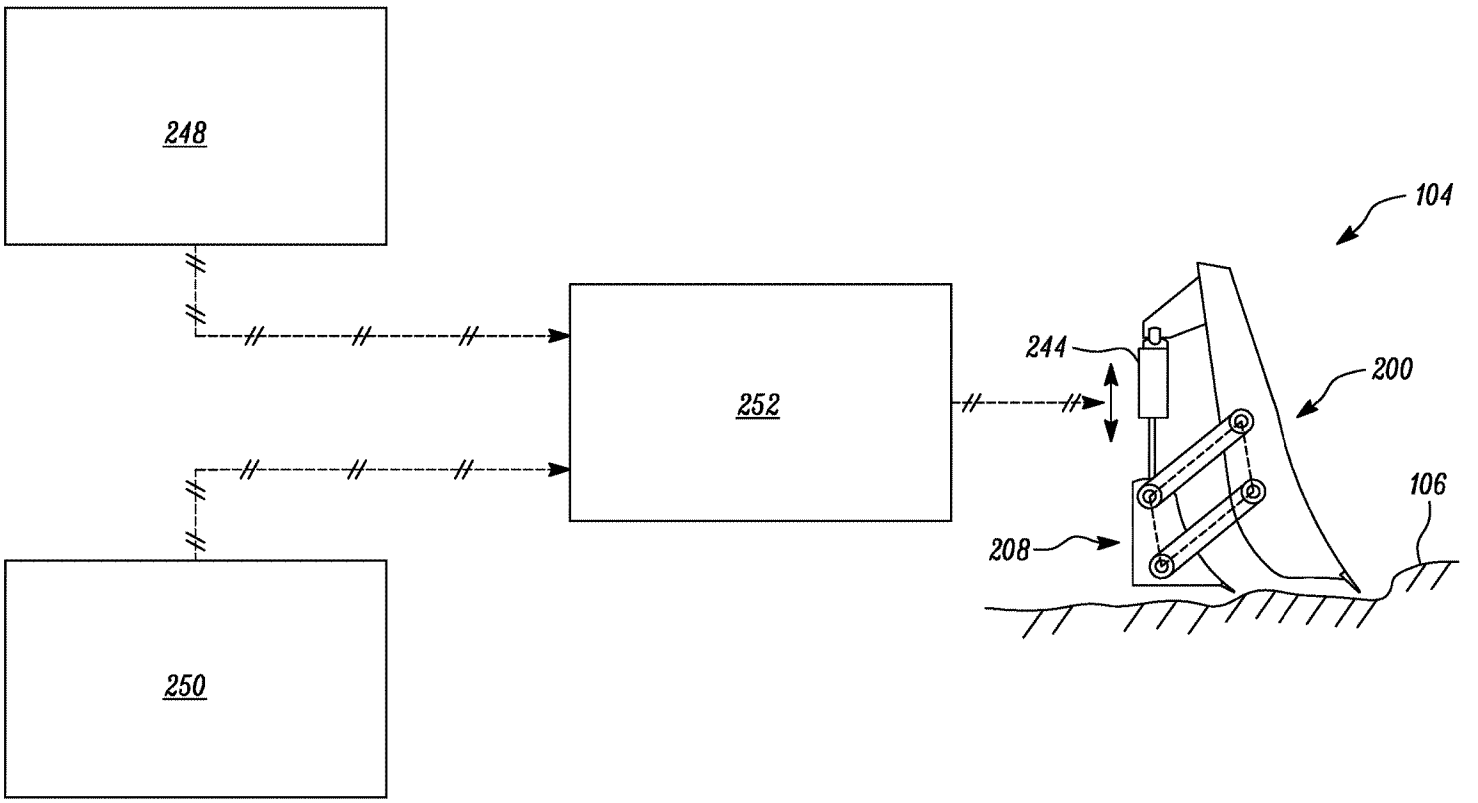
FIG. 4 is a block diagram of a control system for the implement system of the machine, in accordance with an embodiment of the present disclosure.

FIG. 4 illustrates a control system 400 for controlling the implement system 104. The control system 400 includes the first position sensor 248, the second position sensor 250, the controller 252 and the implement system 104. The controller 252 receives signals indicative of the position of the primary blade 200 and the secondary blade 208 from the first position sensor 248 and the second position sensor 250. In one embodiment, the controller 252 may receive the signals indicative of the position of the primary blade 200 and the secondary blade 208 from a single position sensor. The controller 252 already has the initial geometry as well as the final geometry of the ground surface 106 stored in the associated memory.

The controller 252 operates the implement system 104 so as to alter the initial geometry of the ground surface 106 to achieve the final geometry. The primary blade 200 comes into contact with the ground surface 106 before the secondary blade 208, as the secondary blade 208 trails the primary blade 200. The controller 252 receives an intermediate geometry of the ground surface 106 as the primary blade 200 alters the ground surface 106. The initial geometry terrain map keeps on getting continuously updated with the alterations made by the primary blade 200 on the ground surface 106. Further, based on the intermediate geometry of the ground surface 106, the controller 252 operates the first and second actuators 244, 246 of the secondary blade 208 so as to provide the ground surface 106 with the desired final geometry.

Figure 5:
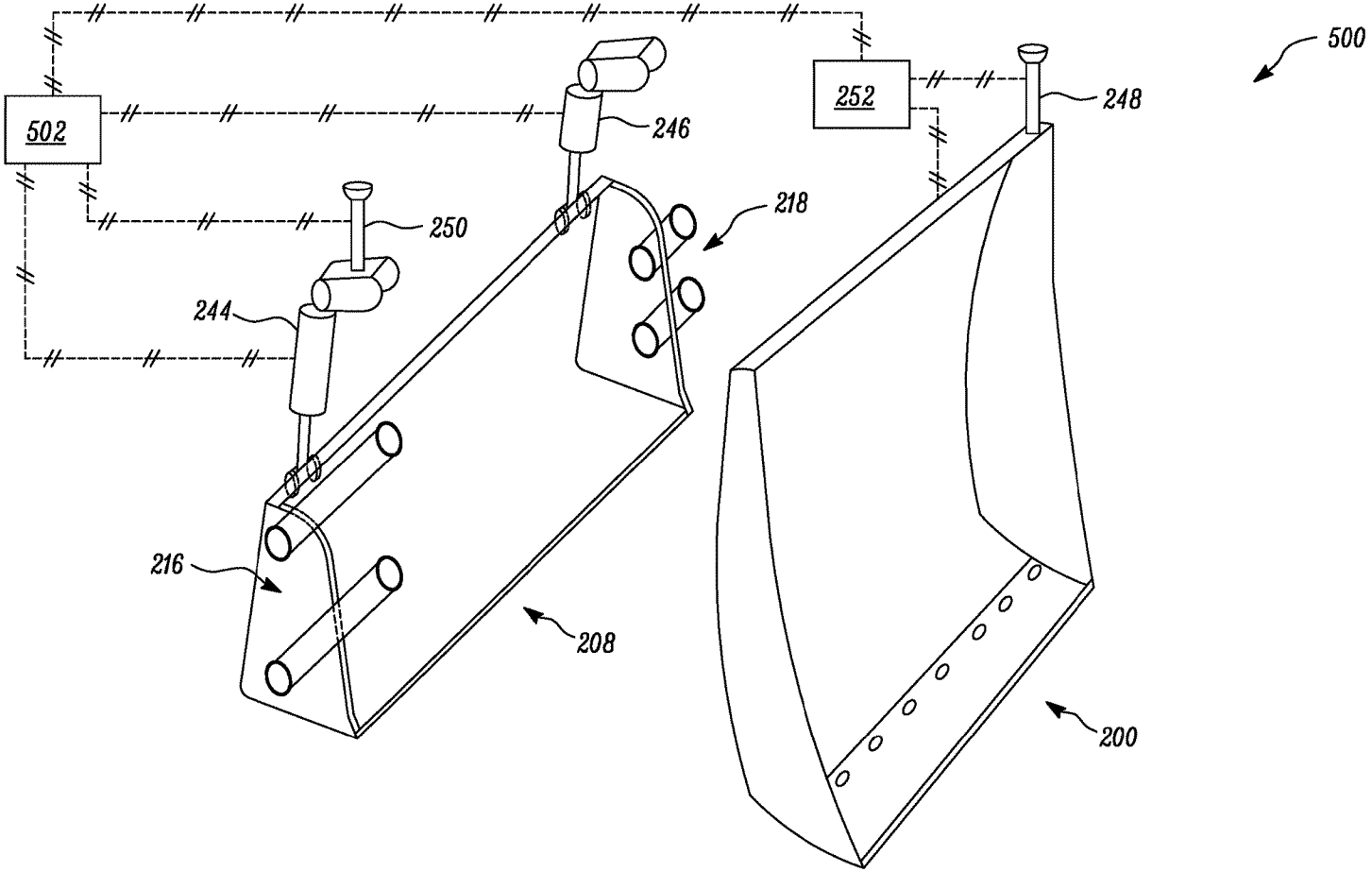
FIG. 5 is a perspective view of the implement system of the machine, in accordance with another embodiment of the present disclosure.

In another embodiment of the present disclosure shown in FIG. 5, a secondary implement system 500 is provided for retrofitting to the machine 100. The machine 100 includes a primary implement system having the primary blade 200 controlled by the controller 252. The machine 100 further includes the first position sensor 248 which generates signals corresponding to the position of the primary blade 200. The secondary implement system 500 includes the secondary blade 208 coupled to the primary blade 200 through the first and second linkage mechanisms 216, 218. The secondary blade 208 is coupled to the primary blade 200 such that the secondary blade 208 trails the primary blade 200. The secondary implement system 500 includes the second position sensor 250 which generates signals corresponding to the position of the secondary blade 208. The secondary implement system 500 further includes a secondary controller 502 which controls the secondary blade 208. The secondary controller 502 is in communication with the controller 252. The secondary controller 502 may have means to be integrated with the controller 252 or the machine control system as well on retrofitting. The secondary controller 502 has the initial geometry terrain map and the desired final geometry terrain map of the ground surface 106 stored in an associated memory of the secondary controller 502.

Figure 6:
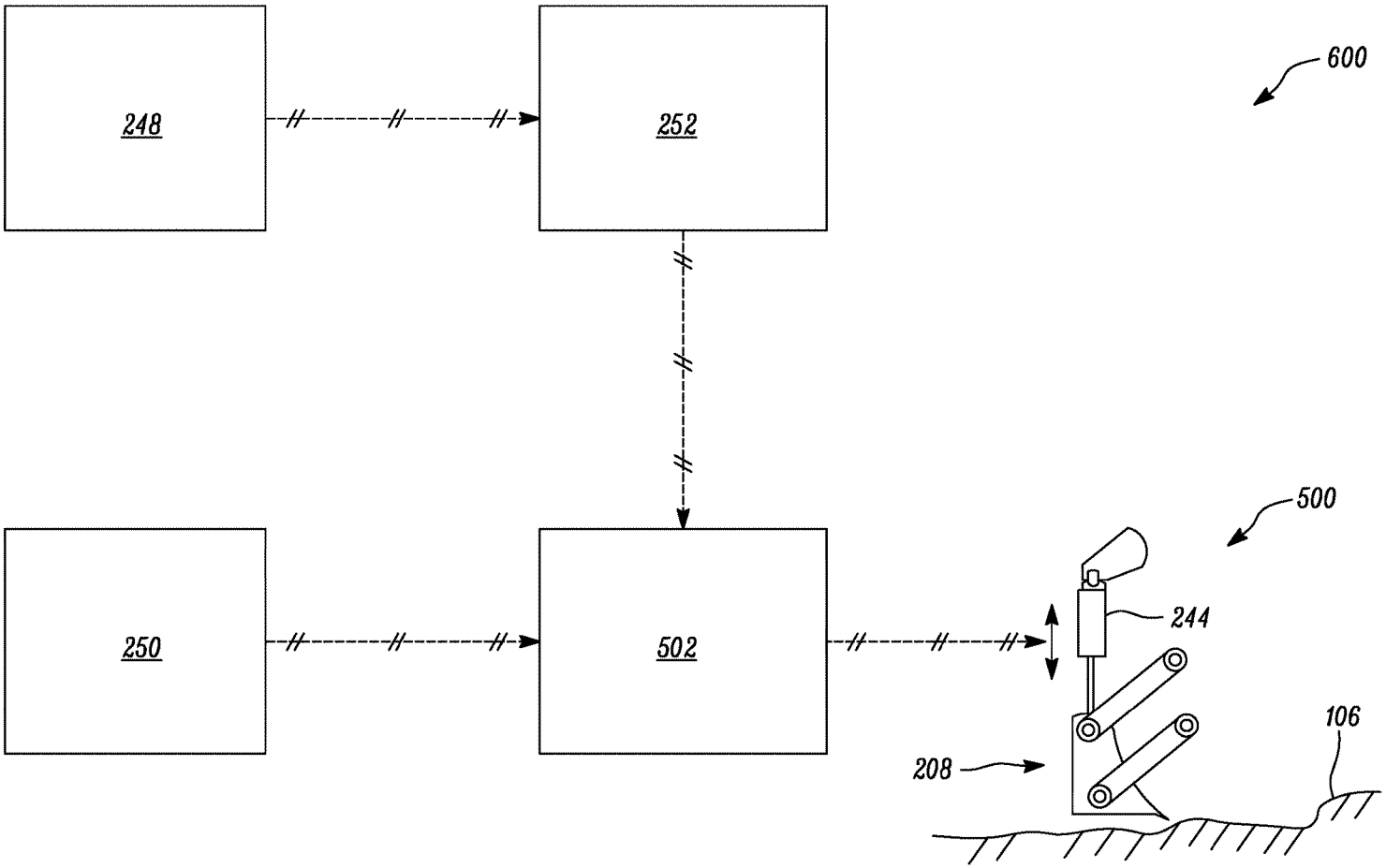
FIG. 6 is a block diagram of a control system for the implement system of the machine, in accordance with another embodiment of the present disclosure.

FIG. 6 illustrates a control system 600 for controlling the secondary implement system 500. The control system 600 includes the secondary blade 208 controlled by the secondary controller 502. The secondary controller 502 is in communication with the second position sensor 250, and the controller 252. The secondary controller 502 receives the signals corresponding to the position of the secondary blade 208 from the second position sensor 250 and the signals corresponding to the position of the primary blade 200 from the controller 252. The controller 252 may receive the signals corresponding to the position of the primary blade 200 from the first position sensor 248. The secondary controller 502 then operates the first and second actuators 244, 246 to control the secondary blade 208 to impart the final geometry to the ground surface 106. The secondary controller 502 may also receive an intermediate geometry of the ground surface 106 after the primary blade 200 has altered the ground surface 106. The initial geometry terrain map may get continuously updated as the primary blade 200 alters the ground surface 106. The secondary controller 502 may then control the secondary blade 208 accordingly to alter the intermediate geometry to impart the desired final geometry to the ground surface 106.

INDUSTRIAL APPLICABILITY

Figure 7:
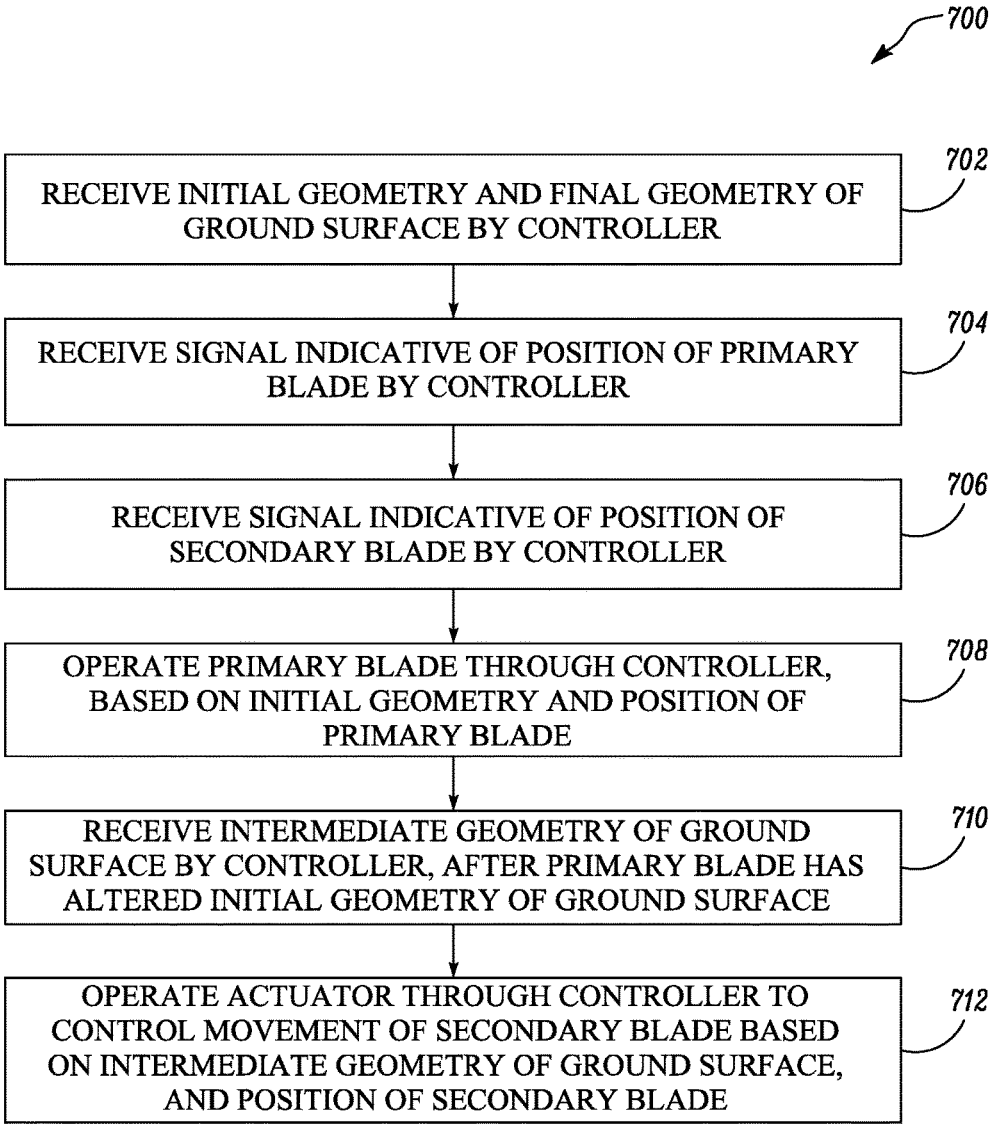
FIG. 7 is a flowchart for a method to control the implement system of the machine, in accordance with an embodiment of the present disclosure.

The present disclosure provides an improved implement system 104 and a method 700 to control the implement system 104. The method 700 is explained with the help of the flow chart shown in FIG. 7. The method 700 at step 702 receives the initial geometry and the final geometry of the ground surface 106 by the controller 252. The controller 252 may receive the initial geometry and the final geometry in form of terrain maps. The controller 252 may have the terrain maps stored in the associated memory as well. The method 700 at step 704 receives the signals indicative of the position of the primary blade 200 by the controller 252. The first position sensor 248 generates the signals indicative of the position of the primary blade 200 and the controller 252 receives the signals from the first position sensor 248.

The method 700 at step 706 receives the signals indicative of the position of the secondary blade 208 by the controller 252. The second position sensor 250 generates the signals indicative of the position of the secondary blade 208 and the controller 252 receives the signals from the second position sensor 250. The method 700 at step 708 operates the primary blade 200 based on the initial geometry of the ground surface 106 and the position of the primary blade 200. The primary blade 200 is operated through the controller 252.

The method 700 at step 710 receives the intermediate geometry of the ground surface 106 after the primary blade 200 has altered the initial geometry of the ground surface 106. The intermediate geometry may be received by the controller 252 in form of terrain map. The method 700 at step 712 operates the first and second actuators 244, 246 of the secondary blade 208 through the controller 252 to control movement of the secondary blade 208. The movement of the secondary blade 208 is controlled so as to impart the final geometry to the ground surface 106 by altering the intermediate geometry. The controller 252 operates the first and second actuators 244, 246 of the secondary blade 208 based on the intermediate geometry of the ground surface 106, and the position of the secondary blade 208.

The present disclosure provides the improved implement system 104 having dual blades i.e. the primary blade 200 and the secondary blade 208. The implement system 104 can be controlled more efficiently than the prior art implement systems as the coarse cutting action performed by the primary blade 200 is followed by the fine cutting action by the secondary blade 208. The primary blade 200 and the secondary blade 208 can be controlled simultaneously or independently to perform same or different actions. The implement system 104 ensures that the required final geometry is imparted to the ground surface 106 in a single pass rather than taking multiple passes performing fine and coarse cutting actions by a same blade in different operational settings. Further, an inherent problem of heavy blade systems to lag behind the control parameters is solved as the secondary blade 208, which performs finishing operation on the ground surface 106, is substantially lighter and can be controlled more effectively.

The present disclosure also provides with an option to retrofit an existing machine 100 with the secondary implement system 500. The secondary implement system 500 can be easily coupled or decoupled as per need of the application for which the machine 100 is to be used. Further, the secondary blade 208 may also be stored in a stowage position when not in use, or when encountering a very rocky or tough terrain on the ground surface 106. Overall, the performance efficiency as well as the productivity of the machine 100 is improved as the desired results are achieved by the implement system 104 in lesser passes with improved accuracy.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An implement system for a machine working on a ground surface, the implement system comprising:
- a primary blade;
- a secondary blade coupled to the primary blade through a linkage mechanism wherein the secondary blade is trailing the primary blade;
- an actuator adapted to control a movement of the secondary blade;
- at least one position sensor configured to generate signals indicative of a position of the primary blade and a position of the secondary blade; and
- a controller communicably coupled to the primary blade, the secondary blade and the position sensor, the controller configured to:
  - receive the signals indicative of the position of the primary blade and the position of the secondary blade; and
  - operate the actuator to control the movement of the secondary blade based on the position of the primary blade and secondary blade.

2. The implement system of claim 1, wherein the controller has an initial geometry and a final geometry of the ground surface stored in an associated memory.

3. The implement system of claim 2, wherein the controller further receives an intermediate geometry of the ground surface after the primary blade has altered the initial geometry, and controls the secondary blade based on the intermediate geometry.

4. The implement system of claim 1, wherein the linkage mechanism coupling the secondary blade to the primary blade is a four bar linkage.

5. The implement system of claim 1, wherein the position sensor is a GPS sensor.

6. The implement system of claim 1, wherein the position sensor includes a first position sensor and a second position sensor, the first position sensor and the second position sensor generate signals indicative of the position of the primary blade and the position of the secondary blade respectively.

7. The implement system of claim 1, wherein the actuator of the secondary blade is one of a hydraulic actuator or a pneumatic actuator.

8. The implement system of claim 7, wherein the primary blade performs a coarse cutting action and the secondary blade performs a fine cutting action on the ground surface.

9. A secondary implement system for retrofitting to a machine, the machine having a primary implement system including a primary blade and a primary controller, the secondary implement system comprising:
- a secondary blade coupled to the primary blade through a linkage mechanism, such that the secondary blade is trailing the primary blade;

an actuator adapted to control a movement of the secondary blade;

at least one position sensor configured to generate signals indicative of a position of the secondary blade; and a secondary controller communicably coupled to the primary controller, the secondary blade and the position sensor, the secondary controller configured to:

receive a signal indicative of a position of the primary blade from the primary controller;

receive the signals indicative of the position of the secondary blade from the position sensor; and operate the actuator to control the movement of the secondary blade based on the position of the primary blade and secondary blade.

10. The secondary implement system of claim 9, wherein the secondary controller has an initial geometry and a final geometry of the ground surface stored in an associated memory.

11. The secondary implement system of claim 10, wherein the secondary controller further receives an intermediate geometry of the ground surface after the primary blade has altered the initial geometry, and controls the actuator based on the intermediate geometry.

12. The secondary implement system of claim 9, wherein the linkage mechanism coupling the secondary blade to the primary blade is a four bar linkage.

13. The secondary implement system of claim 9, wherein the position sensor is a GPS sensor.

14. The secondary implement system of claim 9, wherein the primary controller receives signals indicative of the position of the first blade by a position sensor.

15. The secondary implement system of claim 9, wherein the actuator of the secondary blade is one of a hydraulic actuator or a pneumatic actuator.

16. The secondary implement system of claim 15, wherein the primary blade performs a coarse cutting action and the secondary blade performs a fine cutting action on a ground surface.

17. A method of controlling an implement system for a machine working on a ground surface, the implement system having a primary blade and a secondary blade coupled to the primary blade, the secondary blade trailing the primary blade, the method comprising:

receiving, by a controller, an initial geometry and a final geometry of the ground surface;

receiving, by the controller, a signal indicative of a position of the primary blade;

receiving, by the controller, a signal indicative of a position of the secondary blade;

operating, through the controller, the primary blade based on the initial geometry and the position of the primary blade;

receiving, by the controller, an intermediate geometry of the ground surface, after the primary blade has altered the initial geometry of the ground surface; and operating, through the controller, an actuator to control movement of the secondary blade based on the intermediate geometry of the ground surface, and the position of the secondary blade.

18. The method of claim 17, wherein the secondary blade is coupled to the primary blade through a four bar linkage mechanism.

19. The method of claim 17, wherein the signals indicative of the position of the primary blade and the position of the secondary blade are generated through a GPS sensor.

20. The method of claim 17, wherein the primary blade performs a coarse cutting action and the secondary blade performs a fine cutting action on the ground surface.

* * * * *